United States Patent [19]

Sasaki et al.

[11] 4,161,050

[45] Jul. 17, 1979

[54] HAIR BRUSH

[75] Inventors: Tetsuo Sasaki, Sakura; Yoshimi Tsuchiya, Yachiyo, both of Japan

[73] Assignee: Kao Soap Co., Ltd., Tokyo, Japan

[21] Appl. No.: 919,423

[22] Filed: Jun. 26, 1978

[30] Foreign Application Priority Data

Jul. 1, 1977 [JP] Japan ..... 52-87229[U]
Jan. 30, 1978 [JP] Japan ..... 53-9894[U]

[51] Int. Cl.[2] ..... A46B 9/02
[52] U.S. Cl. ..... 15/159 A; 15/DIG. 5; 132/85; 132/159
[58] Field of Search ..... 15/159, 159 A, 186–188, 15/DIG. 5; 132/159, 161, 120, 85

[56] References Cited

U.S. PATENT DOCUMENTS

| | | | |
|---|---|---|---|
| 1,957,363 | 5/1934 | Snell | 15/191 R |
| 3,727,260 | 4/1973 | Spydevold | 15/159 A |
| 4,030,158 | 6/1977 | Blair et al. | 15/186 |

FOREIGN PATENT DOCUMENTS

| | | | |
|---|---|---|---|
| 1083781 | 6/1960 | Fed. Rep. of Germany | 15/159 A |
| 341791 | 12/1959 | Switzerland | 15/159 A |
| 120341 | 11/1916 | United Kingdom | 15/186 |

*Primary Examiner*—Peter Feldman
*Attorney, Agent, or Firm*—Blanchard, Flynn, Thiel, Boutell & Tanis

[57] ABSTRACT

A hair brush having bristles of at least two different lengths projecting from the hair brush body. The longer bristles have enlarged, substantially spherical ends, the diameters of which are larger than the nominal diameters of the bristles.

4 Claims, 11 Drawing Figures

HAIR BRUSH

BACKGROUND OF THE INVENTION

1. FIELD OF THE INVENTION

The present invention relates to an improvement in or relating to a hair brush.

2. DESCRIPTION OF THE PRIOR ART

One of the fundamental functions of a hair brush is to massage the scalp. In such massaging, however, the scalp is apt to be injured by the sharp ends of the bristles. For this reason, the idea of rounding the ends of brush bristles has been proposed.

However, when the ends of the bristles are rounded, there is brought about the disadvantage that the bristles do not reach the scalp sufficiently and a sufficient brushing of the hair becomes impossible. If the bristle density is decreased in order to improve the brushing effect, a satisfactory hair-dressing effect cannot be expected.

After intensive investigations for overcoming those defects, the inventors have discovered that a hair brush in which the bristles have at least two different lengths and at least the longer bristles have enlarged substantially spherical ends is effective for brushing hair.

SUMMARY OF THE INVENTION

Figure 1:
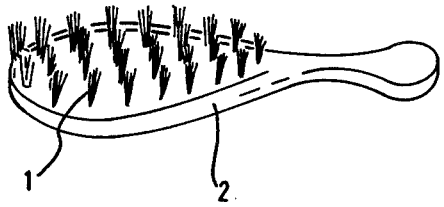
FIG. 1 is a perspective view of a hair brush.
Figure 2:
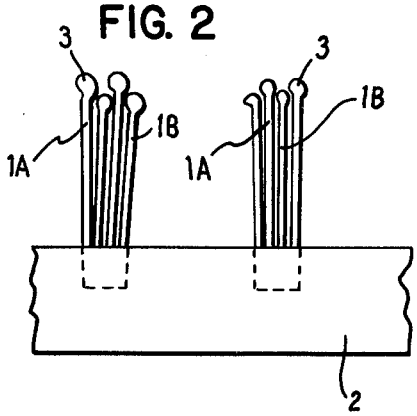
FIG. 2 is an enlarged view of a fragment of the hair brush of the present invention.

The present invention provides a hair brush comprising bundles or tufts 1 of bristles whose lower ends are embedded in a hair brush body 2 of any conventional shape. The bristles in each tuft are comprised of relatively long bristles 1A and shorter bristles 1B. The long bristles 1A project upwardly from the brush body 2 substantially equal distances so that their outer ends lie substantially in a first plane which is spaced upwardly from and extends substantially parallel with the upper surface of the brush body 2. The shorter bristles 1B likewise project upwardly from the brush body 2 substantially equal distances, but they are shorter than the bristles 1A so that their outer ends are below the outer ends of the long bristles 1A. Each tuft contains both long bristles 1A and shorter bristles 1B, preferably approximately equal numbers of both types of bristles. Both types of bristles are substantially uniformly distributed in each tuft so that the long bristles 1A are located adjacent to shorter bristles 1B, and vice versa. The bristles are made of filaments of synthetic resin. The outer ends of at least the long bristles 1A are enlarged and rounded so as to form substantially spherical enlargements 3, the diameters of which are larger than the nominal diameters of the filaments. The shape of the outer ends of the shorter bristles 1B is not critical, but it is preferred that the outer ends be smooth and rounded and they can be shaped to define spherical enlargements, like the enlargements 3 on the longer bristles 1A.

The outer ends of the long bristles 1A of the hair brush of the present invention can contact the scalp during the brushing treatment even if the brush has a high bristle density sufficient for obtaining a hair-dressing effect. Further, since the ends of the long bristles 1A which contact the scalp are substantially spherical, a sufficient massaging action is possible with minimum risk of injury to the scalp.

Furthermore, the hair brush according to this invention is improved in its function and effect when the bristles possess the following characteristics:

(A) The bristles have a nominal diameter of from 0.45 to 0.70 mm, wherein nominal diameter means the "as extruded" diameter of the bristle prior to forming the enlargement 3, (B) the bristles have a length of from 15 to 30 mm, wherein length means the distance the bristles project upwardly above the brush body 2, (C) the bristles are embedded in the brush body in the form of tufts, each tuft containing 2 to 6 bristles, (D) the total number of bristles per unit area of the brushing surface is from 8 to 30 bristles/cm$^2$, and (E) at least one-half of the bristles have enlarged spherical ends 3 whose diameters are from 1.2 to 2.5 times larger than the nominal diameter of the bristles.

The above requirements (A)–(E) are very important. If any of these requirements is not satisfied, a satisfactory hair brush cannot be obtained.

Figure 5:
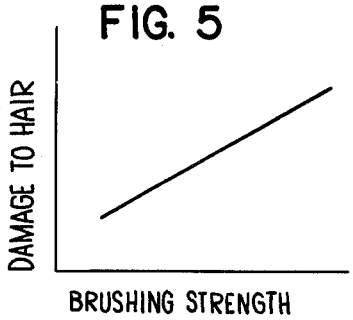
FIGS. 5–11 are graphs showing the effects of the present invention.
Figure 6:
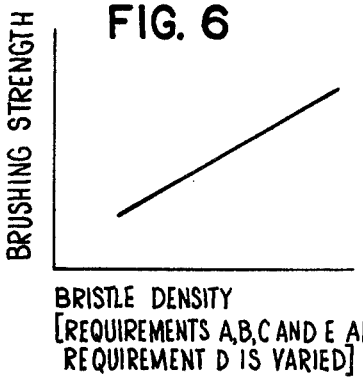
Figure 7:
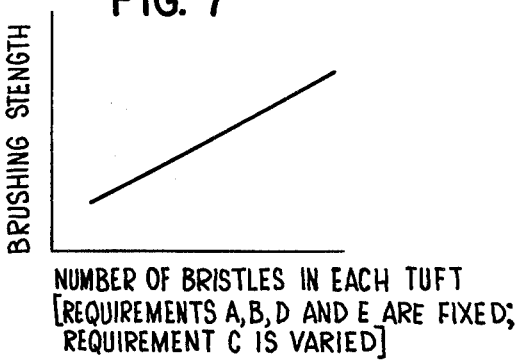
Figure 8:
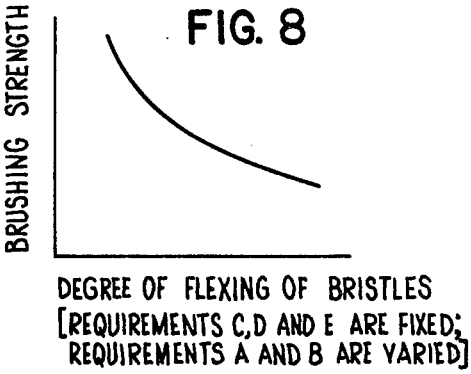

The extent of hair damage caused by brushing is influenced greatly by the force imposed on the hair during the brushing. The general relationship between the degree of damage and the brushing strength is as shown in FIG. 5. The brushing strength differs according to the structure of the brush, as is shown in FIGS. 6–8. The degree of flexing of the bristles is measured by the inclination angle of the bristles when a load is imposed on the bristle ends. It is thus understood that the requirements for preventing damage to hair are as follows:

1. The bristle density (number of bristles per unit area) is not excessively high,
2. The planting number (number of bristles per bunch or tuft) is not excessively high, and
3. The flexibility of the bristles is high.

Figure 9:
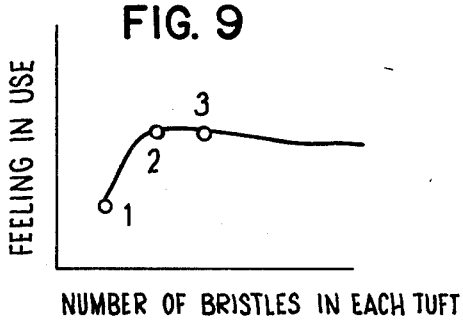
Figure 10:
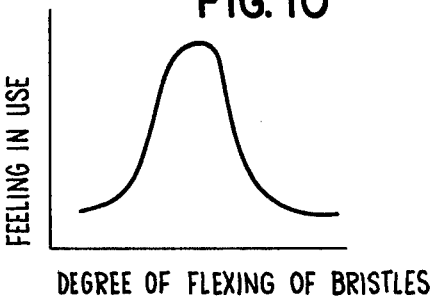
Figure 11:
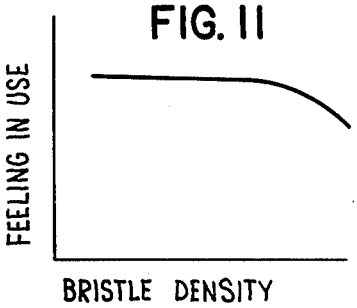

On the other hand, it has been found by sensory evaluation based on the feeling during use of the brush that the planting number of bristles should be two or more per bunch or tuft. Also, there is an optimum range of the degree of flexibility as shown in FIGS. 9 to 11.

If the bristle material and the cross-sectional shape of the bristles are fixed, the flexibility of the bristles depends only on their length and thickness. It has been found that within the range of preferred bristle length of the hair brush, limited as stated above in requirement (B), [a bristle length of less than 15 mm is too short to obtain a sufficient brushing effect and, on the other hand, a brush having a bristle length of more than 30 mm is disadvantageously difficult to use, because the top of the bristle (working point for massage) is too far distant from the base of the brush (dynamic point)], an acceptable flexibility in that range is attained only when the bristle diameter is in the range limited as set forth above in requirement (A), i.e., 0.45 to 0.70 mm. When the bristles are within those optimum ranges, a hair brush having a good feeling in use (sensory evaluation) can be obtained.

Even though it may be possible to obtain bristles possessing acceptable flexibility if the bristle thickness is outside the range of requirement (A) or the bristle length is outside the range of requirement (B), the brush in such a case is difficult to use because the combination of the length and the thickness of the bristle will be, for example, 1 mm in thickness and about 40 to 50 mm in length. Further, in such a case, there cannot be obtained a hair brush which possesses preferred properties with respect to preventing injury to the scalp, while obtaining an adequate massage effect and comfortable feeling during use. When the planting number is outside the range set forth above in requirement (C), in other words, if the bristles are not planted in a bunch containing 2 to 6 bristles, the following defects are observed: If individual bristles are planted separately from each other, the feeling during use is extremely bad and, on the other hand, if the bristles are planted in the form of a bunch comprising more than 6 bristles, they damage the hair unfavorably. Particularly, when the bunch comprises more than 6 bristles, the disadvantages will be serious, namely, hair is pulled from the scalp during the brushing, and the hair is damaged by forming split ends or the hair is weakened because the hair is deformed beyond an elastic limit thereof, whereby the hair may become broken. This is due to the fact that when the hair passes through the root portions of a bunch of bristles, a high friction force is generated on the hair when a large number of bristles is planted in a bunch. If the bristle density is not within the range as stated above in requirement (D), i.e., with less than 8 bristles/cm$^2$, the brushing effect per se becomes insufficient and, on the other hand, when it is more than 30 bristles/cm$^2$, damage of the hair becomes serious. The optimum bristle density is 12–20 bristles/cm$^2$. If the diameter of the enlarged spherical ends of the longer bristles 1A is not within the range as specified above in requirement (E), i.e., when the diameter is more than 2.5 times larger than the nominal bristle diameter, it is difficult for the end of the bristle to reach the scalp and, on the other hand, when the diameter of the enlarged spherical end is less than 1.2 times larger than the nominal bristle diameter, the distribution of stress becomes insufficient, thereby the scalp is rubbed by the bristle end and is likely to be injured, even if the stress is reduced by maintaining the bristle flexibility in an optimum range. In other words, a suitable scalp stimulation cannot be effected unless both a reduction in stress caused by flexing of the bristles and a distribution of the stress over a larger area by using the enlarged spherical bristle ends are provided.

For preventing the scalp from being hurt, a sufficient effect can be obtained if at least one-half of the bristles have enlarged spherical ends, but it is preferred that all the bristles have spherical ends.

As the material for making the bristles according to the present invention, nylon is suitable but other synthetic resins such as polypropylene and polyethylene terephthalate can also be used. Although the flexibility of the bristles varies, depending on the specific material that is used, an excellent hair brush can be obtained if the above requirements (A) to (E) are satisfied.

As for the lengths of the bristles, it is preferred that each bundle or tuft has bristles of two different lengths, wherein the difference in the bristle length of the respective two types is 1 to 10 mm, preferably 2 to 5 mm, in each bundle. However, all of the bristles in a bundle may have the same length (see FIG. 4). Particularly when the bristle density is 16–30/cm$^2$, the above difference in length is important, because it is difficult for the bristle ends to reach the scalp if the spherical ends are close to each other. With this structure, the ends of the longer bristles readily contact the scalp to improve the massage effect. The spherical ends of the longer bristles 1A first contact the scalp and if a stronger force is imposed, the spherical ends of the shorter bristles then contact the scalp. The shorter bristles have a smaller flexing degree and give a more rigid feeling. Therefore, the sense of touch can be altered by controlling the force imposed thereon.

Figure 3:
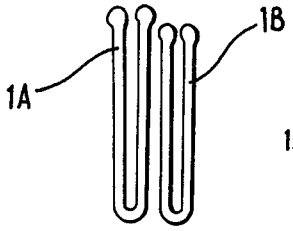
FIGS. 3 and 4 are front views showing embodiments of bristles used in the hair brush of the present invention.
Figure 4:
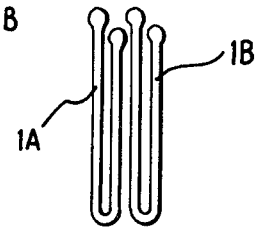

Usually, two bristles are provided by bending a filament in U-shape (FIGS. 3 and 4). The bight portion of such U-shaped filament is embedded in the brush body 2. There can be used separate U-shaped filaments of different lengths and bent in the middle to provide the longer bristles 1A and the shorter bristles 1B, respectively, as shown in FIG. 3, or there can be used U-shaped filaments of the same length with the bight portion thereof being shifted off center to provide a long bristle 1A and a short bristle 1B on each filament, as shown in FIG. 4.

The embodiments of the invention in which an exclusive property or privilege is claimed are defined as follows:

1. A hair brush comprising: a brush body; a plurality of discrete, spaced-apart, tufts of bristles whose inner ends are secured to said brush body and which project away from said brush body, said tufts being arranged on said brush body so that the total number of bristles per unit area of the brushing surface is from 8 to 30 bristles/cm$^2$, each tuft consisting essentially of approximately equal numbers of long bristles of substantially equal length and short bristles, said long and short bristles being substantially uniformly distributed in each tuft, each tuft containing a total of from 2 to 6 bristles, each bristle having a diameter of from 0.45 to 0.70 mm and projecting from the brush body a distance of from 15 to 30 mm, said short bristles projecting from said brush body a distance which is from 1 to 10 mm shorter than the distance said long bristles project from said brush body so that the outer ends of said short bristles are located inwardly from the outer ends of said long bristles, said long bristles having enlarged substantially spherical outer ends wherein the diameters of said outer ends are from 1.2 to 2.5 times larger than the diameters of the remainders of said bristles.

2. A hair brush according to claim 1, wherein the number of bristles per unit area is from 12 to 20 bristles/cm$^2$, and the long bristles project from said brush body a distance which is from 2 to 5 mm longer than the distance said short bristles project from said brush body.

3. A hair brush according to claim 1, in which the bristles are defined by the upstanding legs of U-shaped filaments whose bights are embedded in the brush body, and wherein the lengths of the two legs of each filament are substantially equal whereby the long bristles are provided by U-shaped filaments of one length and the short bristles are provided by U-shaped filaments of shorter length, each tuft having a total of 2 long bristles and 2 short bristles.

4. A hair brush according to claim 1, in which the bristles are defined by the upstanding legs of U-shaped filaments whose bights are embedded in the brush body, the filaments being substantially identical and each filament having one long leg defining a long bristle and short leg defining a short bristle, each tuft having a total of 2 long bristles and 2 short bristles.

* * * * *